US007197980B2

(12) United States Patent
Suzuki

(10) Patent No.: US 7,197,980 B2
(45) Date of Patent: Apr. 3, 2007

(54) ENGRAVING SHEET AND METHOD OF ENGRAVING THE SAME

(76) Inventor: Akira Suzuki, No. 3-6-606 Honcho 4-chome, Kawaguchi-shi, Saitama-ken (JP)

( * ) Notice: Subject to any disclaimer, the term of this patent is extended or adjusted under 35 U.S.C. 154(b) by 551 days.

(21) Appl. No.: 10/630,271

(22) Filed: Jul. 30, 2003

(65) Prior Publication Data

US 2004/0023009 A1 Feb. 5, 2004

Related U.S. Application Data

(62) Division of application No. 10/118,106, filed on Apr. 8, 2002, now abandoned.

(51) Int. Cl.
*B31F 1/07* (2006.01)

(52) U.S. Cl. ..... 101/32; 101/35; 101/171; 101/3.1; 428/141; 428/138

(58) Field of Classification Search ..... 438/138; 101/32, 171, 3.1
See application file for complete search history.

(56) References Cited

U.S. PATENT DOCUMENTS 3,897,964 A * 8/1975 Oka et al. ..... 283/111
5,085,936 A * 2/1992 Herdman ..... 428/337
5,298,307 A * 3/1994 Suzuki et al. ..... 428/141
5,492,370 A * 2/1996 Chatwin et al. ..... 283/110
5,582,103 A * 12/1996 Tanaka et al. ..... 101/32
5,871,833 A * 2/1999 Henbo et al. ..... 428/138
5,904,091 A * 5/1999 Arai ..... 101/32
5,958,528 A * 9/1999 Bernecker ..... 428/29
6,159,659 A * 12/2000 Gelbart ..... 430/306
6,171,734 B1 * 1/2001 Warner et al. ..... 430/10
6,214,521 B1 * 4/2001 Telser et al. ..... 430/281.1
6,465,077 B1 * 10/2002 Lee et al. ..... 428/167

FOREIGN PATENT DOCUMENTS

FR 2561420 A1 * 9/1985

* cited by examiner

*Primary Examiner*—Ren Yan
*Assistant Examiner*—Matthew Marini
(74) *Attorney, Agent, or Firm*—Hoffmann & Baron, LLP

(57) ABSTRACT

An engraving sheet includes a support layer fabricated of biaxially oriented high-density polypropylene, and an engraving layer formed on the support layer and having an opacity of 40%. The engraving sheet is engraved from the engraving layer down to the support layer. The support layer is lower in opacity than the engraving layer with a difference of 20% or more between the opacity of the support layer and the opacity of the engraving layer. The engraving sheet allows a desired pattern, a photograph of the face of an individual, or the like to be engraved thereon, and presents a finger touch similar to that of paper, and is hard to be torn even after it is bound by a sewing machine or a stapler.

1 Claim, 1 Drawing Sheet

ENGRAVING SHEET AND METHOD OF ENGRAVING THE SAME

CROSS-REFERENCE TO RELATED APPLICATIONS

This application is a divisional application of U.S. application Ser. No. 10/118,106, filed Apr. 8, 2002 now abandoned, which claims priority from Japanese Application No. JP 2001-378439, filed on Dec. 12, 2001.

BACKGROUND OF THE INVENTION

1. Field of the Invention

The present invention relates to an engraving sheet having a support layer and an engraving layer formed on the support layer with the engraving layer to be engraved in accordance with a desired pattern, a photograph of the face of an individual or the like down to a depth to the support layer, and a method of engraving the engraving sheet.

2. Description of the Related Art

In known anti-counterfeit techniques, an image is engraved on an identification card, a passport, a bank book, or a plastic sheet of a variety of cards for identification, and a reflected light bearing the image is checked to see if it is a genuine engraved image. However, the determination method dependent on the reflected light only needs a complicated technique. Japanese Unexamined Patent Application Publication No. 6-15794 discloses an engraving sheet that is formed of a support layer and an engraving layer formed on the support layer with the engraving sheet to be engraved deep into the support layer to form a water mark.

A reverse image under the presence of transmitted light rays entering from behind is recognized as an engraved picture to determine authenticity of the image. The reflected light image, typically distinctly formed, is easy to transfer. To be applied as a certificate, the engraved image has much room for improvement from the following points. Namely, the engraved image needs to be difficult to counterfeit, and needs to be durable, and elastic much like paper, and excellent as an image, and presents no environmental problems when it is burned in a disposal process.

SUMMARY OF THE INVENTION

Accordingly, it is an object of the present invention to provide an engraving sheet that is excellent, as a certificate including a water mark, in finger touch, durability, disposability, and transparency, and the ease of use, and a method of engraving the engraving sheet.

An engraving sheet of the present invention includes a support layer and an engraving layer formed on the support layer, with the engraving layer to be engraved down to the support layer, wherein the support layer is fabricated of biaxially oriented high-density polypropylene, the engraving layer has an opacity of 40% or more, and the support layer is lower in opacity than the engraving layer with a difference of 20% or more between the opacity of the support layer and the opacity of the engraving layer.

The biaxially oriented high-density polypropylene is formed into a sheet by biaxially stretching an ordinary high-density polypropylene, and is translucent so that an image is directly engraved therethrough to form a good engraved sheet. The biaxially oriented high-density polypropylene sheet is elastic and hard to tear. The biaxially oriented high-density polypropylene is set to be lower in opacity than the engraving layer, the opacity of which is 40% or more. A difference in opacity between the support layer and the engraving layer is 20% or more, and is typically 25% or so when the biaxially oriented high-density polypropylene has an appropriate thickness, for example, as thick as 60 μm. The engraving layer is set to be 40% or more in opacity so that the engraving layer results in an engraved image like a water mark on a banknote. Using a signal in relatively high level, the support layer having a relatively low opacity is also engraved, thereby presenting a distinct reflected light image.

The support layer fabricated of the biaxially oriented high-density polypropylene provides an appropriate hardness, a high tensile strength, and a high durability. The support layer, presenting a low bond to other materials, provides the following great advantages. Paper sheets used for passports or bank books range in thickness from 60 to 100 μm. The engraving sheet within this thickness range meets or exceeds the finger touch and the elasticity of the paper sheet. Users easily get used to the engraving sheet if used instead of a paper sheet certificate. Since the engraving sheet is hard to tear, no reinforcement is required. The engraving sheets are thus bound using a sewing machine or a stapler. Even if a surface protective film is peeled off from the engraving sheet, it still continuously maintains its flexibility. Since the engraving sheet is not solvent resistant to petroleum-based, aromatic, ketonic, and ester solvents in particular, the sheet is hard to counterfeit. Because of its nonadhesive quality with other materials, restoring the engraving sheet using another material is difficult once the engraving layer is peeled off therefrom. Counterfeiting the engraving sheet is thus extremely difficult.

Since the difference between the opacity of the support layer and the opacity of the engraving layer is more than 20% but less than 30%, the reflected light image is hard to transfer but the sharpness thereof drops to a level allowing it to be still visibly recognized. Since the support layer, fabricated of biaxially oriented high-density polypropylene, is electron-beam cross-linked, the support layer is solidified to be easily engraved.

To engrave an image in the engraving sheet, an image pickup device picks up an original picture, generating a picture signal in which a color signal of the engraving layer becomes relatively lower in level, and an engraving device engraves the support layer in response to the picture signal depending on the magnitude of the picture signal. The engraved picture becomes a positive image under the presence of reflected light rays and a negative image under the presence of transmitted light rays entering from behind. The image pickup device picks up an original picture, generating a picture signal in which a color signal of the engraving layer becomes relatively higher in level, and the engraved picture becomes a negative image under the presence of reflected light rays and a positive image under the presence of transmitted light rays entering from behind.

The original picture is a photograph of the face of an individual, and the engraving layer is whitened. The picture signal with a black signal relatively higher in level than a white signal presents an engraved image, becoming a positive image under the presence of reflected light and becomes a negative water-mark image under the presence of transmitted light entering from behind. The picture signal, if reversed, presents an engraved image, becoming a negative image under the presence of reflected light and a positive image under the presence of transmitted light entering from behind. An engraved image of the photograph of a face of an individual for identification is thus obtained.

DESCRIPTION OF THE PREFERRED EMBODIMENTS

Figure 1:
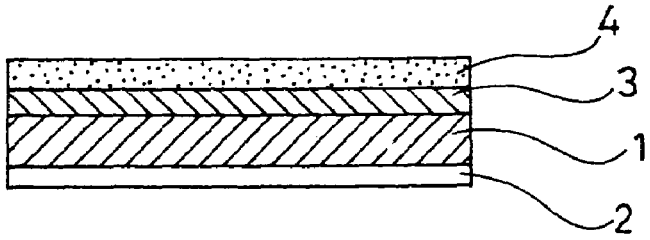
FIG. 1 is a cross-sectional view of an engraving sheet in accordance with one embodiment of the present invention.

A biaxially oriented high-density polypropylene sheet used as a support layer is obtained by biaxially stretching an ordinary high-density polypropylene sheet. The biaxially oriented high-density polypropylene sheet is preferably electron-beam cross-linked to solidify the surface thereof for ease of graving. The biaxially oriented high-density polypropylene sheet having a thickness falling within a range of from 40 μm to 120 μm presents an opacity of 15 to 60%, and presents a good engraved image if engraved in accordance with a drawing or a picture. The polypropylene sheet is burned in a disposal process with the toxicity thereof controlled. Incidentally, biaxially oriented high-density ethylene based sheets are highly transparent, and are difficult to form a naturally looking image therefrom. The burning of the ethylene based sheet is not preferable from the environmental point of view.

An engraving layer is formed on the support layer so that the engraving layer is engraved in appropriate color of gradations with respect to the translucent polypropylene as the support layer. When being directly deposited on the support layer, the engraving layer is preferably fabricated of a material, exhibiting a good adhesion to polypropylene, such as polyolefin, or polyvinyl chloride. By engraving the sheet formed of a color engraving layer, an obtained engraved picture is as good as that which is obtained from a combination of a paper making technique and a water-mark technique in which a drawing or a picture is formed using a special ink, or that which is obtained from an ink printing process in which a water-mark drawing or picture is formed on a finished paper sheet. Incidentally, an engraved image has an unnatural look if engraved in an engraving sheet manufactured of an engraving sheet deposited on the biaxially oriented high-density ethylene sheet.

When the engraving sheet is formed of a film of paint, a dye or a pigment is used as a film forming colorant composition with a resin such as polyolefin used as a film forming binder. A paint, containing a variety of paint assisting additive and a carrier medium, is applied on the support layer, if necessary, with an undercoat layer sandwiched between the paint and the support layer. The film forming binder is preferably a cross-link polymer so that the biaxially oriented high-density polypropylene sheet is easier to dissolve than the engraving layer with a solvent to make it hard to counterfeit the image. The engraving layer may be fabricated of a plurality of sublayers having different colors.

A plurality of undercoat layers may be sandwiched between the support layer and the engraving layer. The undercoat layers may include a so-called primer coating layer that functions as an intermediary to bond the engraving layer to the support layer, and a basic pattern printing layer to give an ornamental effect to the engraved image. The support layer may have a liner layer, which may include an ornamental layer to the engraved image like the undercoat layer. Third and fourth layers may be sandwiched between the support layer and the engraving layer or may be arranged beneath the support layer so that a color exposed through an engraved portion is used for identification. Hidden characters printed with a fluorescent pigment or a basic pattern printing may be used to prevent counterfeiting. The basic pattern printing may be performed on the back side of the engraving layer, or may be performed on an intermediate layer between the support layer on the back side of the support layer and the liner layer.

Pigments and dyes contained as a colorant in the engraving layer may be any organic or inorganic ones having any color, including white inorganic pigments such as particulate silica, titanium white, and calcium carbonate, yellow inorganic pigments such as chrome yellow, zinc yellow, yellow oxide, and cadmium yellow, yellow organic dyes such as Hansa yellow, and quinoline yellow lake, red inorganic pigments such as cadmium red, blood red, and red lead oxide, red organic dyes such as alizarin red, para red, and lithol red, blue inorganic pigments such as ultramarine, cobalt blue, and Prussian blue, and blue organic dyes such as phthalocyanine blue, and indathrone blue. A colorant is preferably particulate silica, calcium carbonate, or titanium white, and among them, titanium white is more preferable for its particle state and dispersion property, and even a small amount of titanium white presents a large whitening effect.

When an image is engraved in an engraving sheet having a white or a light color near white based on a photograph of the face of an individual, an image pickup device scans the original picture, thereby generating a picture signal, and the picture signal is fed to an engraving device which drives an engraving knife. The picture signal is reversed into a signal with a black signal thereof higher in level than a white signal thereof. In this way, in an engraving process, the engraving sheet is not engraved at all or slightly engraved in response to the white signal, and is engraved much to a depth reaching the support layer in response to the black signal or a signal near black. The engraved image appears positive in response to the reflected light and negative in response to the transmitted light entering from behind. After the engraving process, a transparent protective paint is preferably applied on the engraved image. If the engraving device operates in response to the picture signal from the image pickup device not reversed with the white signal higher in level than the black signal, the engrave image appears negative under the presence of the reflected light and positive under the presence of the transmitted light entering from behind.

The engraving layer may be of any color besides white, and the engraving device operates in response to a light and dark picture signal which varies in level between black and white. When a picture is drawn in a particular color, for example, green, the engraving layer is green, and is engraved in response to a picture signal with green dropping in signal level so that the green color appears positive.

An excessively thin engraving layer allows itself to be peeled off in an area, thereby causing the resulting image to be monotonous. When a wedge-like super-stiffness knife is used on the engraving layer with the thickness thereof falling within a range from 1 μm to 35 μm, the original picture is engraved with the shading thereof faithfully reproduced.

EXAMPLE 1

An undercoat paint (Lamister, Tradename of Toyo Ink Mfg. Co., Ltd. for a paint mixture of two liquids with particulate silica added) was applied on an electron-beam cross-linked, axially oriented high-density polypropylene support layer having a thickness of 60 μm. After drying the paint, the paint film was as thick as 3 μm. A two-liquid setting ink was applied to a thickness of 5 μm as a white engraving layer through a screen printing process, and the resulting engraved image was then covered with a transparent protective film. The positive image and the negative image with the dark/light signal inverted and the engraved image are distinct. The engraving sheets were bound using a sewing machine, like a passport, and were subjected to a page turning test for 500 times, and no tear took place along a perforated line. When the engraving sheet was processed using toluene, the support layer was swollen, and no abnormality took place in the protective covering.

EXAMPLE 2

An undercoat paint (Acronal YJ2721D, Tradename of Mitsubishi Yuka Badische Co., Ltd.) was applied on an electron-beam cross-linked, biaxially oriented high-density polypropylene support layer having a thickness of 60 μm, to a thickness of 1 g/m$^2$ at dry weight, and a paint containing the following compositions was then applied on the undercoat paint, thereby forming an engraving layer.

| | |
|---|---|
| Acrylic based emulsion (Acronal S-886S, Tradename of Mitsubishi Yuka Badische Co., Ltd.) | 50 weight % |
| Calcium carbonate | 90 weight % |
| Titanium white | 10 weight % |
| Dispersant | 0.3 weight % |
| Anti-foaming agent | 0.1 weight % |
| Mildew-proofing agent | 0.2 weight % |
| Ultraviolet absorber | 0.3 weight % |

The thickness of the engraving layer subsequent to a drying operation was 17 μm. A basic pattern was printed in the area other than an engraved region and a signature region. The positive image and the negative image under the presence of the reflected light were obtained, resulting in an engraved image. The engraved sheets were bound using a sewing machine, and subjected to 500 page turning cycles. The engraved sheets exhibited good results in this page turning test. The engraved sheets also exhibited good results in an anti-chafing property test, an emboss process withstand capability test, and a light-resistance test.

EXAMPLE 3

The thickness of the biaxially oriented high-density polypropylene sheet was varied to vary opacity of an engraving sheet having the same engraving layer as that of Example 2, as listed in Table 1. A card printing machine as an engraving device was used to engrave the same image, and resulting engraved sheets were compared to each other.

TABLE 1

| | SUPPORT LAYER | | ENGRAVING LAYER | | | OPACITY |
|---|---|---|---|---|---|---|
| TEST No. | THICKNESS μm | OPACITY % | THICKNESS μm | OPACITY % | SHARP-NESS | DIFFER-ENCE % |
| 1 | 40 | 15 | 17 | 55 | ○ | 40 |
| 2 | 45 | 18 | 17 | 55 | ○ | 37 |
| 3 | 55 | 20 | 17 | 55 | ○ | 35 |
| 4 | 60 | 25 | 17 | 55 | Δ | 30 |
| 5 | 65 | 27 | 17 | 55 | Δ | 28 |
| 6 | 70 | 30 | 17 | 55 | Δ | 25 |
| 7 | 75 | 33 | 17 | 55 | Δ | 22 |
| 8 | 80 | 35 | 17 | 55 | Δ | 20 |
| 9 | 85 | 38 | 17 | 55 | X | 17 |
| 10 | 90 | 42 | 17 | 55 | X | 13 |
| 11 | 100 | 50 | 17 | 55 | X | 5 |

Notes
○: HIGH Δ: MIDDLE X: LOW

As seen from Table 1, at the middle sharpness at which the opacity difference ranges from 20% to 30%, the reflected light image is slightly less sharp, but the resulting engraved image is less subject to transfer. Using the transmitted light entering from behind, an engraved image sufficiently recognizable is obtained.

EXAMPLE 4

Figure 2:
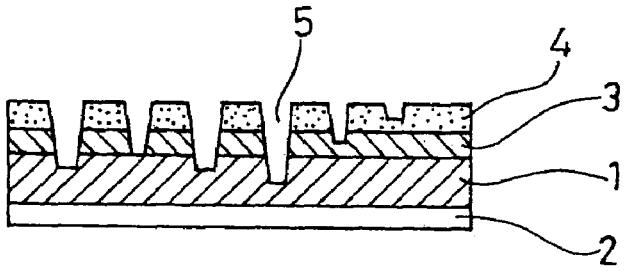
FIG. 2 is a cross-sectional view illustrating the engraved sheet.
Figure 3:
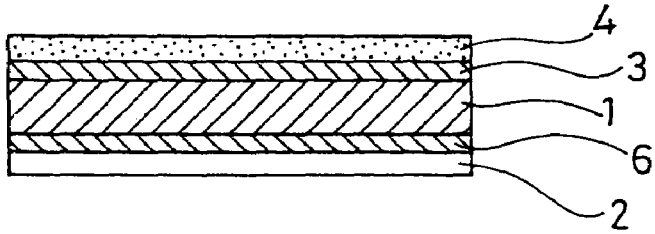
FIG. 3 is a cross-sectional view of an engraving sheet in accordance with another embodiment of the present invention.

Referring to FIG. 1, a liner layer 2 was attached on the back side of the support layer 1 fabricated of the biaxially oriented high-density polypropylene sheet as thick as 60 μm. An undercoat layer 3 is arranged on the support layer 1 by applying a white offset ink, and an engraving layer 4 was then deposited on the undercoat layer 3. The engraving sheet thus resulted. Referring to FIG. 2, by engraving the engraving sheet so deeply that a reversed picture signal becomes close to a black level, the engraved image becomes a positive image under the presence of the reflected light. The engraved image becomes a negative image under the presence of the transmitted light entering from behind. Referring to FIG. 3, a basic pattern printing layer 6 may be deposited beneath the support layer 1 using a white offset ink.

What is claimed is:

1. A method of engraving an engraving sheet with an engraving device in accordance with a picture signal, with the engraving sheet formed of a support layer and a whitened engraving layer arranged on the support layer with the engraving layer to be engraved down to the support layer, wherein the support layer is fabricated of biaxially oriented high-density polypropylene, the whitened engraving layer has an opacity of 40% or more, and the support layer is lower in opacity than the whitened engraving layer with a difference of 20% or more between the opacity of the support layer and the opacity of the whitened engraving layer, the method comprising the steps of:

generating a picture signal in which a color signal of the whitened engraving layer becomes relatively lower in level when an original picture of a photograph of a face is picked up with an image pickup device; and producing an engraved picture to present a positive image under the presence of reflected light rays and a negative water-mark image under the presence of transmitted light rays entering from behind by allowing the engraving device to engrave the whitened engraving sheet down to the support layer in response to the picture signal depending on the magnitude of the picture signal.

* * * * *